US005313675A

United States Patent [19]

Tinen

[11] Patent Number: 5,313,675

[45] Date of Patent: May 24, 1994

[54] BATH AID DEVICE

[76] Inventor: Jay Tinen, 624 Raleigh Rd., Glenview, Ill. 60025

[21] Appl. No.: 812,864

[22] Filed: Dec. 20, 1991

Related U.S. Application Data

[63] Continuation of Ser. No. 431,771, Nov. 6, 1989, abandoned.

[51] Int. Cl.[5] ..... A47K 3/02

[52] U.S. Cl. ..... 4/580

[58] Field of Search ..... 4/580–583, 4/548, 559

[56] References Cited

U.S. PATENT DOCUMENTS

| | | | |
|---|---|---|---|
| D. 35,304 | 11/1901 | Pendergast | 4/538 X |
| 2,140,902 | 12/1938 | Fischer | 4/581 |
| 2,302,806 | 11/1942 | Senter | 4/559 X |
| 4,047,259 | 9/1977 | Lotis | 4/583 X |
| 4,356,575 | 11/1982 | Terry | 4/559 |
| 4,630,323 | 12/1986 | Sage et al. | 4/580 |
| 4,937,897 | 7/1990 | Barnabie | 4/580 |

*Primary Examiner*—Charles E. Phillips

*Attorney, Agent, or Firm*—Michael, Best & Friedrich

[57] ABSTRACT

A portable one-piece bath aid device is disclosed for use in conjunction with a bath tub wherein the bath aid device assists one in the bathing of another. The bath aid device has a kneeling section and an elbow rest section to provide comfort to the user and has a storage area which may contain various bathing articles such as shampoos, soaps and cloths commonly used in bathing to provide convenience to the user.

5 Claims, 2 Drawing Sheets

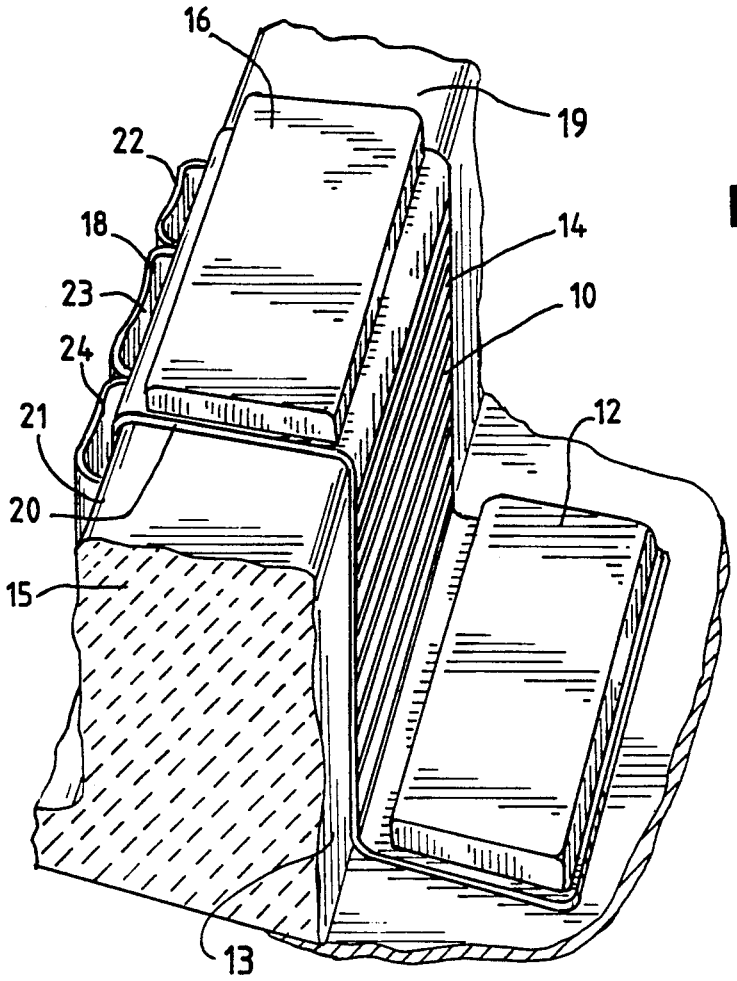
Fig. 1
Fig. 4
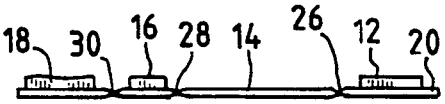
Fig. 2
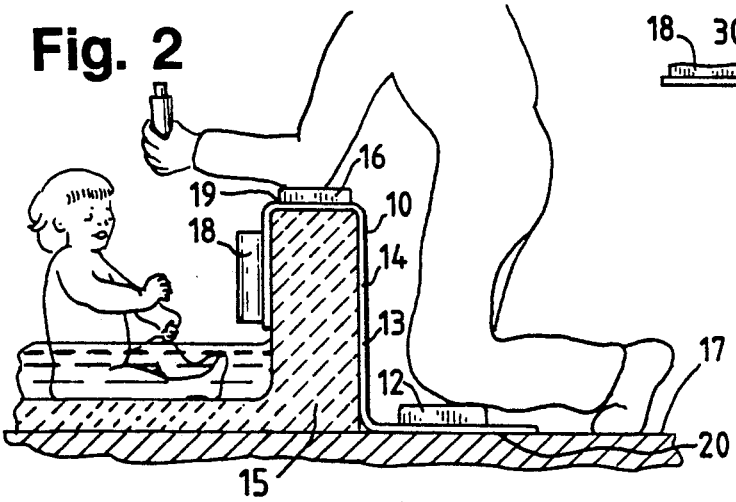
Fig. 5
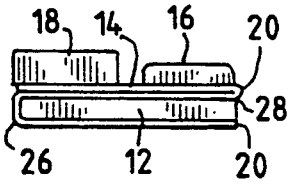
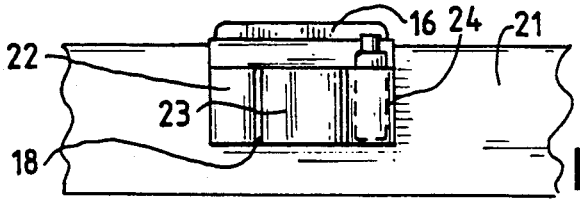
Fig. 3

BATH AID DEVICE

This is a continuation of Ser. No. 07/431,771 filed Nov. 6, 1989, now abandoned.

BACKGROUND OF THE INVENTION

1. Field of the Invention

The present invention relates generally to a bath aid device, and more particularly to a novel device used to assist one in the bathing of another, especially infants and children.

2. Prior Art

The process of one person bathing another has long been a problem for the one performing the bathing. This bathing process is normally carried out over the side of a conventional bath tub or other such washing structure. Examples of such cases, are where a parent is bathing an infant or small child, or in the health care industry where a nurse or health care agent assists in the bathing of a physically handicapped or geriatric person. Where such bathing takes place over the side of a bath tub or similar structure, the process of bathing is made awkward for the one performing the bathing, and additionally may cause great discomfort to the person assisting. Additionally, bathing articles, such as shampoos, soaps and wash cloths are not easily accessible. These bathing articles are normally located in the corners of the tub or may be placed on the floor next to the person performing the bathing. In either case, these bathing articles are not readily accessible to the user, and often spill and create a mess wherever they may be located. There has long been a need therefore, to cure the problems associated in bathing another, wherein the person performing the bathing can do so comfortably and have bathing articles readily accessible to them.

SUMMARY OF THE INVENTION

Accordingly, it is an object of the present invention to provide a bath aid device which provides comfort to the user.

It is a further object of the present invention to provide a bath aid device which provides for containment of bathing articles.

It is a further object of the present invention to provide a bath aid device which is portable in nature so that it may easily be removed from the bathing area during periods of non-use.

It is a further object of the present invention to provide a bath aid device with the above characteristics which is efficient and economical.

Other objects, features and advantages of the present invention will be readily apparent from the following description of a representative embodiment thereof, taken in conjunction with the accompanying drawings, although variations and modifications may be affected without departing from the spirit and scope of the novel concepts embodied in the disclosure.

BRIEF DESCRIPTION OF THE DRAWINGS

FIGS. 1 is a front perspective view showing the bath aid device positioned over the outer wall of a bath tub.

FIG. 2 is a cross-sectional view of the bath aid device of FIG. 1, positioned over the outer wall of a bath tub.

FIG. 3 is a front elevational view showing the storage area of the bath aid device of FIG. 1 as it would look from inside a bath tub.

FIG. 4 is a side view of the bath aid device of FIG. 1 shown laying flat in an extended position.

FIG. 5 is a side view of the bath aid device of FIG. 4 shown in a folded position convenient for storage.

DETAILED DESCRIPTION OF THE PREFERRED EMBODIMENT

Figure 8:
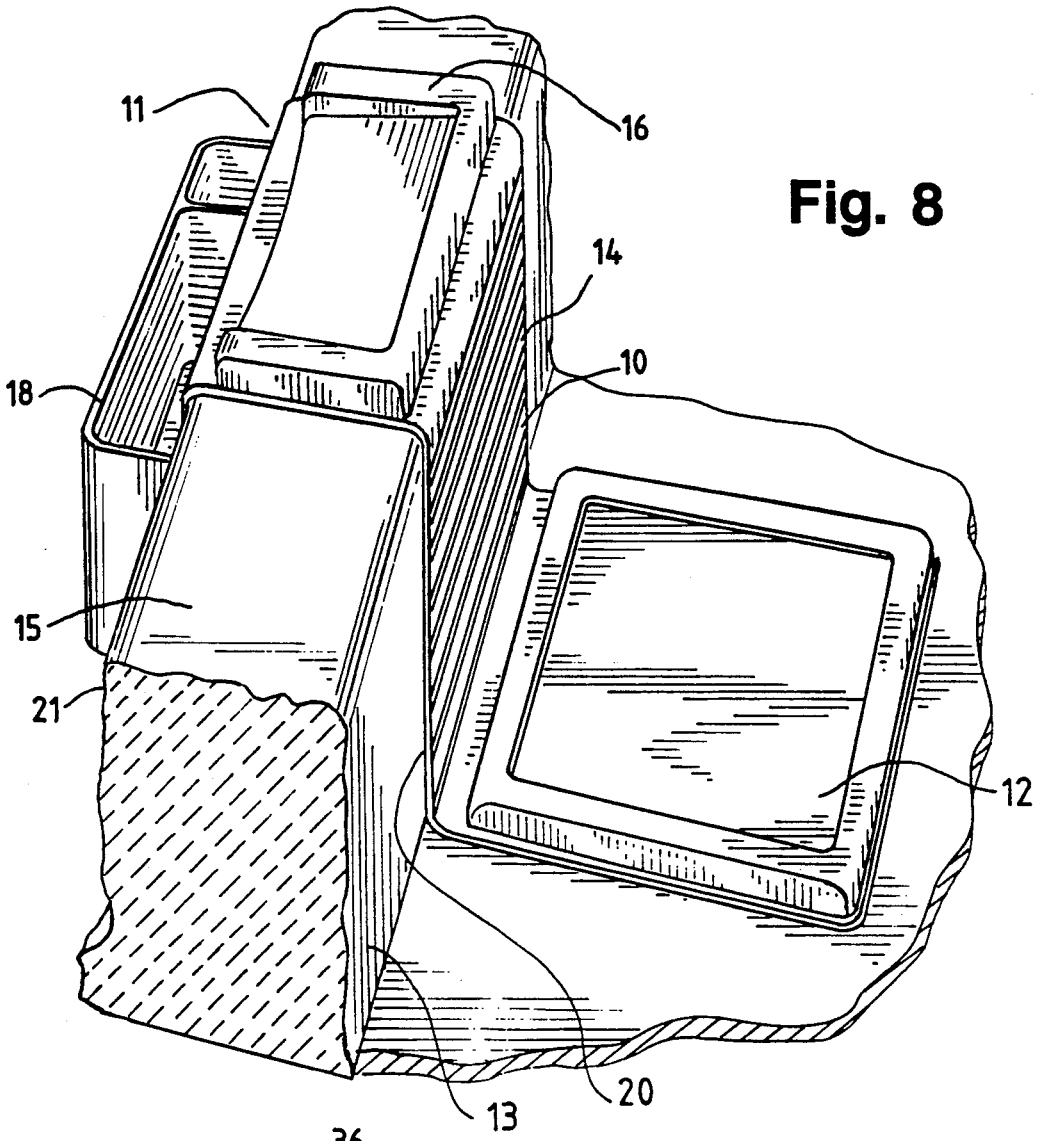
FIG. 8 is a front perspective view of an additional embodiment of the present invention showing the bath aid device positioned over the outer wall of a bath tub.

Referring now to the drawings, wherein like reference characters designate identical or corresponding parts, and more particularly, to FIGS. 1 and 2 thereof, there is illustrated a bath aid device 10, having a kneeling section 12, a vertical riser section 14, an elbow rest section 16 and a storage area section 18. A continuous sheet of thermoplastic material forms a substrate 20 upon which sections 12, 14, 16 and 18 are formed. The bath aid device 10 is constructed and arranged for positioning over a bath tub 11. In the preferred embodiment, kneeling section 12 is formed integral with and is constructed of the same thermoplastic material as substrate 20. Kneeling section 12 is rectangular in shape and is preferably formed to a thickness ranging from one half to five inches. This will create a comfortable padded area for the user to kneel or sit on. In an alternative embodiment, kneeling section 12 may be constructed of a urethane foam pad which is glued or otherwise attached to substrate 20, or may be encased within a thermoplastic material which is heat sealed to substrate 20.

Additionally, kneeling section 12 of bath aid device 10 is formed on substrate 20 in a position which is set back from the outer side 13 of the bath tub wall 15, so that water which may splash over the bath tub wall 15, will not drip onto the kneeling section 12. In an alternative embodiment, as illustrated in FIG. 8, kneeling section 12 is inclined downward away from the outer side 13 of the bath tub wall 15, so that if splashing occurs, any water which may land on kneeling section 12, will run off kneeling section 12 rather than collecting thereon and forming a puddle.

Similar to the kneeling section 12, the elbow rest section 16 is formed integral with and constructed of the same thermoplastic material as substrate 20 in a preferred embodiment. Arm rest section 16 is rectangular in shape and is preferably formed to a thickness ranging from one half to five inches. This will create a comfortable padded area on which the user may rest their elbows or forearms, as shown in FIG. 2. In an alternative embodiment, elbow rest section 16 may be constructed of a urethane foam pad which is glued or otherwise attached to substrate 20, or may be encased within a thermoplastic material which is heat sealed to substrate 20. In an alternative embodiment, as illustrated in FIG. 8, elbow rest section 16 is inclined downward toward the inside of bath tub 11 so that if splashing occurs, any water which may land on arm rest 16 will run back down into bath tub 11. As can be seen in FIG. 2, kneeling section 12 of bath aid device 10 is located on the floor 17 in front of bath tub wall 15 and elbow rest section 16 rests on the top side 19 of bath tub wall 15, and vertical riser section 14 of substrate 20 runs therebetween.

Storage area section 18, is formed integral with and of the same material as substrate 20 in the preferred embodiment. In an alternative embodiment, as illustrated in FIG. 8, storage area section 18 can be formed separately and glued or otherwise attached to substrate 20. In the preferred embodiment, storage area section 18 is divided into first, second and third storage compartments 22, 23 and 24 respectively. In an alternative embodiment, storage area section 18 may be divided into any number of storage compartments, as shown in FIG. 8. Storage area section 18 of bath aid device 10 is located against the inner side 21 of bath tub wall 15.

As earlier stated, substrate 20 is formed of a continuous sheet of thermoplastic material which is subdivided into four identifiable sections, 12, 14, 16 and 18, respectively. The subdivision into the four sections comprised of kneeling section 12, vertical riser section 14, elbow rest section 16 and storage area section 18 may be marked by first, second and third living hinges 26, 28 and 30 respectively. Living hinge 26 is formed longitudinally across substrate 20 between kneeling section 12 and vertical riser section 14. Living hinge 28 is formed longitudinally across substrate 20 between vertical riser section 14 and elbow rest section 16. Living hinge 30 is formed longitudinally across substrate 20 between elbow rest section 16 and storage area section 18. Living hinges 26, 28 and 30 can be formed in substrate 20 by applying a combination of heat and pressure directly to a line longitudinally across substrate 20, thereby forming a living hinge which is of lesser thickness than the standard thickness of substrate 20, as can be seen in FIG. 4. Living hinges 26, 28 and 30 would provide further flexibility to an otherwise semi-rigid bath aid device 10, and would allow bath aid device 10 to better conform to the shape of a bath tub wall as illustrated in FIGS. 1 and 2. This flexibility would also be maintained without compromising the durability of bath aid device 10. As illustrated in FIG. 5, bath aid device 10 can be folded into a compact unit for convenient storage during periods of non-use.

Figure 6:
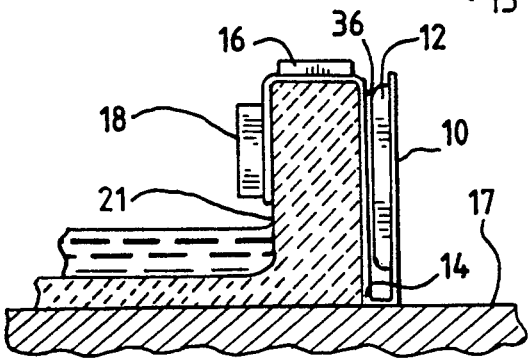
FIG. 6 is a side view of an additional embodiment of the present invention showing modular sections of the bath aid device bonded together.

In an alternative embodiment, as illustrated in FIG. 6, sections 12, 14, 16 and 18 may be individually formed and later attached together at their respective longitudinal edges as represented by 32 and 34 by any of the commonly known means such as adhesive bonding, electromagnetic bonding, friction joining, magnetic heat sealing, radio frequency sealing, thermo-bonding and ultrasonic bonding. Additionally, one or more suction cups of a conventional construction (not shown) may be attached to the underside of either vertical riser section 14 or elbow rest section 16 to secure bath aid device 10 to bath tub wall 15, thereby offsetting any weight differential caused by loading storage area section 18 with bathing articles. It is anticipated that weights or other commonly known means could also be used to achieve this result.

Figure 7:
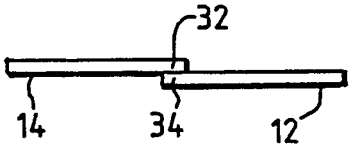
FIG. 7 is a cross-sectional view of an additional embodiment of the present invention showing the bath aid device of FIG. 2 having the padded kneeling area folded up and held off the floor during periods of non-use.

In another alternative embodiment, as illustrated in FIG. 7, bath aid device 10 may be constructed, such that kneeling section 12 may be folded up off the floor, and held against vertical riser section 14 by means of Velcro® 36 or other commonly known adhering means.

The foregoing merely explains and illustrates the invention, and the invention is not limited thereto except insofar as those who have the disclosure before them are able to make modifications and variations thereto without departing from the scope of the invention.

I claim as my Invention:

1. A bath aid device for use in conjunction with a bathtub wherein said bath aid device assists one outside of said bathtub in the bathing of another within said bathtub, said bath aid device comprising:

a padded area for keeling or sitting;

a padded forearm and elbow rest;

a semi-rigid vertical portion interconnecting said padded area for kneeling or sitting and said padded forearm and elbow rest; said padded area for kneeling or sitting and said padded forearm and elbow rest being substantially thicker than said semi-rigid vertical portion;

a storage area for storing soaps, shampoos, washclothes, and other bathing articles;

wherein said padded area for kneeling or sitting rests on the floor adjacent and perpendicular to the sidewall of said bathtub, said padded area for kneeling or sitting being foldably connected to said semi-rigid vertical portion which extends upwardly along said outer portion of said bathtub wall, said vertical section being foldably connected to said padded forearm and elbow rest and wherein said padded forearm and elbow rest is located on the top side of said bathtub wall;

said padded forearm and elbow rest further being foldably connected to said storage area when said storage area is located against the inner wall of said sidewall of said bathtub.

2. A bath aid device as described in claim 1, wherein said storage area comprises a plurality of storage compartments for convenient containment of a plurality of different sized and shaped bathing articles.

3. A bath aid device as described in claim 1, wherein said storage area has a plurality of perforations in its bottom to allow water to drain therefrom, back into said bath tub.

4. A bath aid device as described in claim 1, wherein said bath aid device is constructed of a thermoplastic material.

5. A bath aid device as described in claim 2 wherein said padded area is inclined in a backwardly direction away from said bath tube for allowing water to drain from said pad to keep ones knees and buttock dry;

said padded forearm being inclined in a forwardly direction for allowing water to drain therefrom into said bath tub; and wherein said bath aid device is removable from said bath tub for storage during periods of non-use.

* * * * *